US011008206B2

(12) United States Patent
Pappas

(10) Patent No.: US 11,008,206 B2
(45) Date of Patent: May 18, 2021

(54) DRINK DISPENSER SYSTEM

(71) Applicant: Louis Pappas, Glenview, IL (US)

(72) Inventor: Louis Pappas, Glenview, IL (US)

( * ) Notice: Subject to any disclaimer, the term of this patent is extended or adjusted under 35 U.S.C. 154(b) by 0 days.

(21) Appl. No.: 15/937,477

(22) Filed: Mar. 27, 2018

(65) Prior Publication Data

US 2019/0300355 A1 Oct. 3, 2019

(51) Int. Cl.
*B67D 1/00* (2006.01)
*B67D 1/08* (2006.01)

(52) U.S. Cl.
CPC ..... *B67D 1/0878* (2013.01)

(58) Field of Classification Search
CPC .. B67D 1/0084; B67D 1/1243; B67D 1/0878; B67D 1/0881; B67D 1/0016; B67D 1/0021; B67D 1/0023; B67D 7/426; B67D 1/0086
USPC ..... 222/66, 144.5, 129.4, 113, 145.6
See application file for complete search history.

(56) References Cited

U.S. PATENT DOCUMENTS 4,162,028 A * 7/1979 Reichenberger ..... B67D 1/0041 200/5 R
4,433,795 A * 2/1984 Maiefski ..... B67D 7/303 222/14
4,632,275 A 12/1986 Parks
4,673,108 A * 6/1987 de Man ..... B67D 1/0084 200/5 A
4,795,061 A * 1/1989 Peckjian ..... B67D 1/0016 222/129.2
4,969,576 A 11/1990 Merrill et al.
5,202,954 A 5/1993 Black et al.
5,335,705 A 8/1994 Morishita et al.
5,450,882 A 9/1995 Cragun
5,730,324 A 3/1998 Shannon et al.
5,757,667 A 5/1998 Shannon et al.
6,220,047 B1 4/2001 Vogel et al.
6,609,431 B1 8/2003 Tietsworth et al.
6,685,054 B2 2/2004 Kameyama
(Continued)

FOREIGN PATENT DOCUMENTS

JP 07-141561 A 6/1995
JP 2003-118795 A 4/2003
WO WO 2011/137502 A1 11/2011

OTHER PUBLICATIONS

FDB Partnership, LP, "Installation and Operation Manual for the Models FBD562 and FBD563 Frozen Beverage Dispensers with AFC™," 48 pp. (2012).

*Primary Examiner* — Charles P. Cheyney
(74) *Attorney, Agent, or Firm* — Leydig, Voit & Mayer, Ltd.

(57) ABSTRACT

A drink dispenser system includes an ingredient supply container including a beverage ingredient, and a source of water. An ingredient supply sensor is operatively associated with the ingredient supply container and configured to sense when the ingredient supply container is empty or nearly empty and generate a signal indicative of the empty or nearly empty state. A handheld dispenser in fluid communication with the ingredient supply container and the source of water includes an indicator. A controller communicates with the ingredient supply sensor and is configured to cause activation of the indicator in response to the signal from the sensor indicative of the empty or nearly empty state.

20 Claims, 1 Drawing Sheet

(56) References Cited

U.S. PATENT DOCUMENTS

| | | | | |
|---|---|---|---|---|
| 6,856,251 | B1 | 2/2005 | Tietsworth et al. | |
| 6,874,660 | B2 * | 4/2005 | Bertone | A47J 31/401 222/1 |
| 7,036,687 | B1 * | 5/2006 | Lowe | A47J 31/401 222/129.1 |
| 7,832,592 | B2 | 11/2010 | Bodemann | |
| 9,221,667 | B2 * | 12/2015 | Hershberger | G01D 4/002 |
| 9,485,549 | B2 * | 11/2016 | Hershberger | G06Q 10/08 |
| 9,624,087 | B2 * | 4/2017 | Tuyls | B67D 7/02 |
| 9,704,329 | B2 * | 7/2017 | Locke | G07F 13/00 |
| 10,323,975 | B2 * | 6/2019 | McCoy | B67D 1/00 |
| 2002/0130136 | A1 | 9/2002 | Segal | |
| 2003/0080644 | A1 | 5/2003 | Nelson et al. | |
| 2006/0208913 | A1 | 9/2006 | Christoffersen et al. | |
| 2010/0320231 | A1 * | 12/2010 | Martindale | B67D 1/0084 222/113 |
| 2014/0166374 | A1 * | 6/2014 | Deng | G01G 21/28 177/239 |
| 2016/0060091 | A1 * | 3/2016 | Hecht | B67D 1/0086 362/109 |
| 2018/0257919 | A1 * | 9/2018 | Balstad | A47J 31/402 |

* cited by examiner

DRINK DISPENSER SYSTEM

BACKGROUND OF THE INVENTION

The system under consideration relates to a drink dispensing system such as those used to dispense various types of carbonated drinks from a hand-held or table-top device. Such dispensing systems typically include a source of pressurized gas, for example, carbon dioxide, a source of water, a plurality of drink mixes or syrups, and a multi-valve dispenser. The dispenser may include a hand-held "gun" unit or may be configured to be fixed in place, for example, on a bar or other work support, or be integrated into a multi-dispener cabinet such as a fountain drink dispenser.

When a particular drink is dispensed, the user depresses a button on the dispenser, which simultaneously causes a flow of gas, water and syrup to flow to a mixer disposed close to the outlet of the device. The desired beverage is mixed and immediately dispensed. Certain machines further include chillers for the water provided for mixing, or inline chillers to cool the mixed beverage before dispensing. One common shortcoming of known systems is a lack of user information concerning the remaining reserves of compressed gas and the various syrups used to mix the various beverages dispensed by the device. As is often the case, for example, when the syrup for a particular beverage is running low or has run out, the quality of the beverage dispensed is affected and the user or customer is dissatisfied.

SUMMARY OF THE DISCLOSURE

In one aspect, the disclosure describes a drink dispenser system. The drink dispenser system includes an ingredient supply container including a beverage ingredient, and a source of water. An ingredient supply sensor is operatively associated with the ingredient supply container and configured to sense when the ingredient supply container is empty or nearly empty and generate a signal indicative of the empty or nearly empty state. A handheld dispenser in fluid communication with the ingredient supply container and the source of water includes an indicator. A controller communicates with the ingredient supply sensor and is configured to cause activation of the indicator in response to the signal from the sensor indicative of the empty or nearly empty state.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration as used herein refer to a specified structural size and shape.

Figure 1:
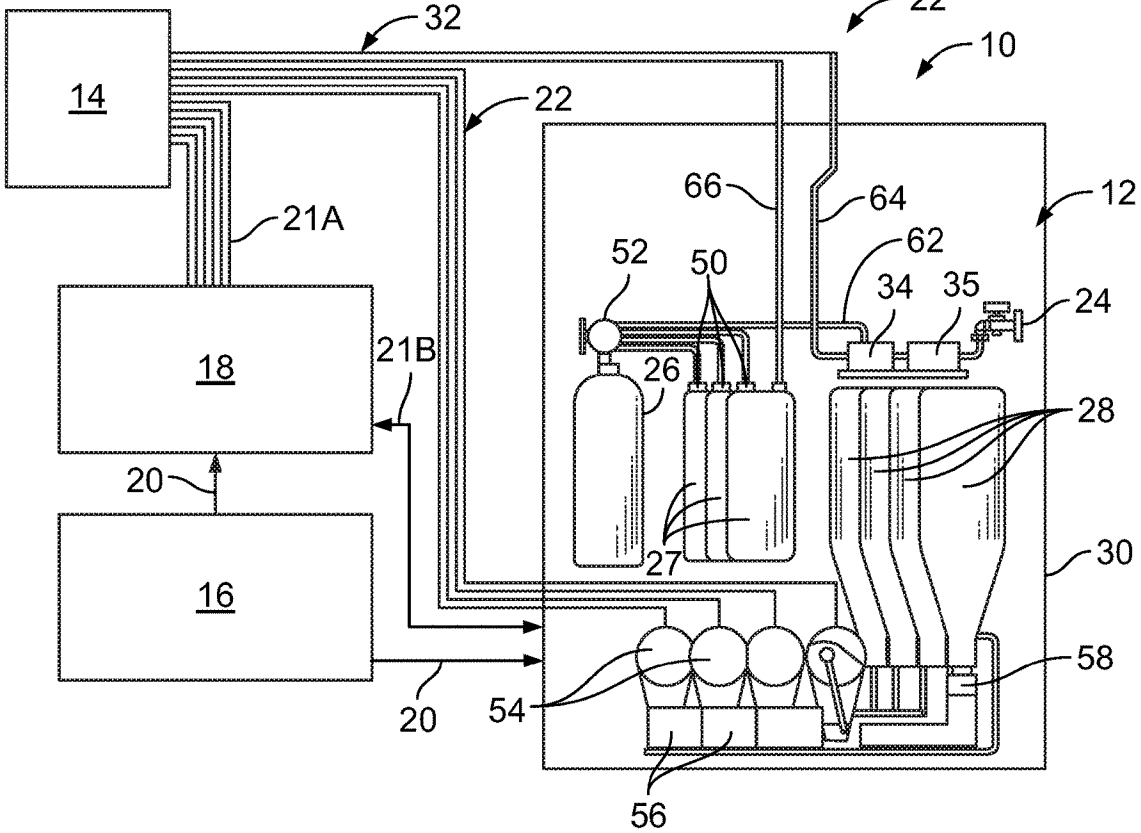
FIG. 1 is a drink dispenser system according to one embodiment of the disclosure.

Reference is made to FIG. 1, which generally illustrates a drink dispensing system 10, according to one embodiment of the disclosure. The system 10 may be adapted for use in "postmix" or "premix" fountain drink equipment. Postmix refers to equipment designed to mix a fountain drink syrup and carbonated water at a given ratio, typically five parts water to one part syrup, on location, to produce and dispense a fountain drink comparable to a canned or bottled carbonated drink. "Postmix" is to be differentiated from "premix", which refers to mixing of syrup and carbonated water prior to delivery of the product to the location for dispensing. Premix fountain drink equipment does not require the availability of water or carbon dioxide gas other than the use of carbon dioxide gas as a pressurizing agent for delivery of the premix fountain drink product to serving valves. One skilled in the art will understand that the illustrated exemplary system could be adapted or configured to a postmix or a premix configuration or other drink dispensing systems. An embodiment of such a system 10 is illustrated herein.

Among the principal elements of the drink dispensing system 10 is an ingredient supply system 12 and a dispenser 14. The ingredient supply 12 may include one or more of a water source 24, a $CO_2$ source 26, at least one carbonation vessel 27, and a plurality of drink containers 28 including mixes, syrups, or beverage ingredients or bases housed within or cooled by an optional housing with a cooling unit 30. The ingredient supply 12 may include a power supply 16, an electronic or electrical controller or control system 18, a plurality of electrical power lines 20, signal lines 21, and fluid lines 22.

One embodiment of the ingredient supply 12 includes a housing, cabinet or a similar enclosure or framework 30, which is sized and shaped to house the elements of the ingredient supply, and which permits easy access, cleaning and integration into a restaurant, bar or other food and/or beverage-serving environment. The housing 30 may be a cooling unit, such as a refrigerator. The housing 30 may be provided with panels, openings, doors, fixtures, fasteners, connectors, and the like (not shown) for fixing the ingredient supply elements in place, access to a supply of water and electricity, as is well known, while providing the necessary interconnections between elements and to permit access to the elements thereof. Alternatively, only some of the elements of the ingredient supply 12 may be housed within the housing 30.

The water supply 24 may include a connection to a standard municipal water supply or a supply of bottled water or another water source and may be provided with both a fluid valve 34 and an optional pressure sensor 35 in communication with controller 18. The fluid valve 34 is configured to direct water from the water supply 24 into the carbonation vessel 27 through conduit 62 when the valve is open and shut off the water supply when closed. The fluid valve 34 may also be configured to direct water from the water supply 24 directly to the dispenser 14 by conduit 64 responsive to a signal generated by the controller 18 in response to the operation of a selected control of the dispenser. The fluid valve 34 may be configured to open and permit the flow of water into the carbonation vessel 27 automatically.

The water supply 24 pressure sensor 35 is in communication with the controller 18, and may be disposed between the water supply and the $CO_2$ source 26 and/or the carbonation vessel 27 to sense the pressure of water from the water supply. The sensor 35 may indicate an interruption in the flow of water from the water supply 24 and/or other conditions.

The carbonation vessel 27 is supplied with water from the water supply 24 and carbon dioxide from the $CO_2$ source 26. The carbonation vessel 27 may include one or a plurality of containers, as is well known, to store a desired capacity of carbonated water. In one embodiment, the carbonation vessel 27 may be provided with a sensor 50, such as a float level sensor, that is in communication with controller 18 and configured to determine or generate a signal indicative of the level of carbonated water in the vessel 27. When the level of carbonated water in the vessel 27 reaches a selected low threshold, the controller 18 may generate a signal that causes the valve 34 to open, permitting water from the water supply 24 to enter the vessel 27. When the level of water reaches a high threshold level detected by the sensor 50 a signal is generated that causes the controller 18 to close the valve 34.

The $CO_2$ source 26 may be a conventional pressurized tank as is well known. The $CO_2$ source 26 is provided with a valve, pressure regulator, and pressure sensor 52 in communication with the controller 18. The $CO_2$ source 26 provides gaseous $CO_2$ to the carbonation vessel 27 to produce soda water, as is well known, and in some embodiments also provides a pressure source to move fluids from the ingredient supply to the dispenser 14.

The ingredient supply 12 includes at least one drink base container 28, which may contain a drink base in the form of a syrup, for example. Typically the drink base container 28 is a box or bag and may be configured to release the base ingredients therefrom by way of a gravity feed. The drink base containers 28 each may be in communication with a separate feed pump 54 that pumps the drink base within the drink base container 28 to the dispenser in response to a signal from the controller 18.

Fluid lines 22 interconnect the ingredient supply 12 and the dispenser 14 permitting drink syrup from base containers 28 to be conveyed to the dispenser where the drink syrup is mixed with water from the water supply 24 or carbonated water from the carbonation vessel 27. The fluid lines 22 for each one of the drink syrups is separate. The water from the water supply 24 and carbonated water from the carbonation vessel 27 are provided with separate fluid lines, respectively lines 64 and 66.

Base container 28 are provided with ingredient supply sensors 56 operatively associated with the feed pumps 54 and the drink base containers 28. The base sensors 56 may sense the volume of drink syrup pumped by feed pumps 54 or some other characteristic of the pumps or containers to indicate when the containers are empty or are nearly empty. The base containers 28 may be disposed upon a weighing system 58. The pumps 54, sensors 56, and/or weighing system 58 may be in communication with controller 18 and provided with power from power supply 16. The sensors 56 and/or the weighing system 58 are used by the controller 18 to determine the operational status of the drink containers 28 and in particular when the containers 28 are empty or nearly empty.

The power supply 16 may include a connection to an external source of electricity. Alternatively, the power supply may be a battery or other source of electricity. The power supply 16 includes standard electrical connections and standard wiring 20 to connect to and power the controller 18, cooling unit 30, and other electrically powered elements of the system 10. The power and signal lines 20, 21 interconnecting the elements of the ingredient supply 12 and the dispenser 14 may be conventional electrically conducting wiring, for example. The power lines 20 also operate components on the dispenser 14.

Power for the power supply 16 and system 10 may be obtained from a standard 110-120 volt AC current supply. The power supply may further incldue a battery or other power storage device that will maintain operation of the system in the event of a power loss at the standard power supply. It will be understood by those skilled in the art that power is supplied to the cooling unit 30, if it is electrically powered, which may be coupled directly to the outside electrical current source. For safety reasons, the power to some of the components may be supplied at a reduced voltage, usually less than 24 volts, which may be accomplished by a stepdown transformer (not shown) placed anywhere on one more of the power lines 20 prior to the component. High voltage currents are insulated from and separated from the lower power circuits as is conventional.

The control system 18 and any control sub-system modules of this disclosure may be of any conventional design having hardware and software configured to perform the calculations and send and receive appropriate signals to perform the operations of the system 10. The control system 18 may include one or more controller subunits, and may be configured to perform ingredient supply functions, temperature and pressure control functions, monitoring functions of the status of various elements of the system, alert functions, and other processes of the system 10. The controller 18 may be of any suitable construction, however in one example it comprises a digital processor system including a microprocessor circuit having data inputs and control outputs, operating in accordance with computer-readable instructions stored on a computer-readable medium. Typically, the processor will have associated therewith long-term (non-volatile) memory for storing the program instructions, as well as short-term (volatile) memory for storing operands and results during (or resulting from) processing.

Signal lines 21B interconnect the controller 18 with the plurality of valves and/or pumps operatively associated with components of the ingredient supply 12, for monitoring the status of and for controlling the flow of water from the water source 24, the flow of $CO_2$ from the $CO_2$ source 26, and the flow of drink mix or syrups from base container 28 to the dispenser 14. The signal lines 21B also interconnect the controller 18 to one or more type of the sensors 35, 52, 56, and 58 for sensing the status of any or all of the water source 24, the $CO_2$ source 26, and the drink mix or syrups 28. The signal lines 21A also interconnect the controller 18 to the dispenser 14 to carry signals to and from the dispenser. One set of the signal lines 21A interconnect the controller 18 with the dispenser 14 and another set of signal lines 21B interconnect the controller with components of the ingredient supply 12.

Figure 2:
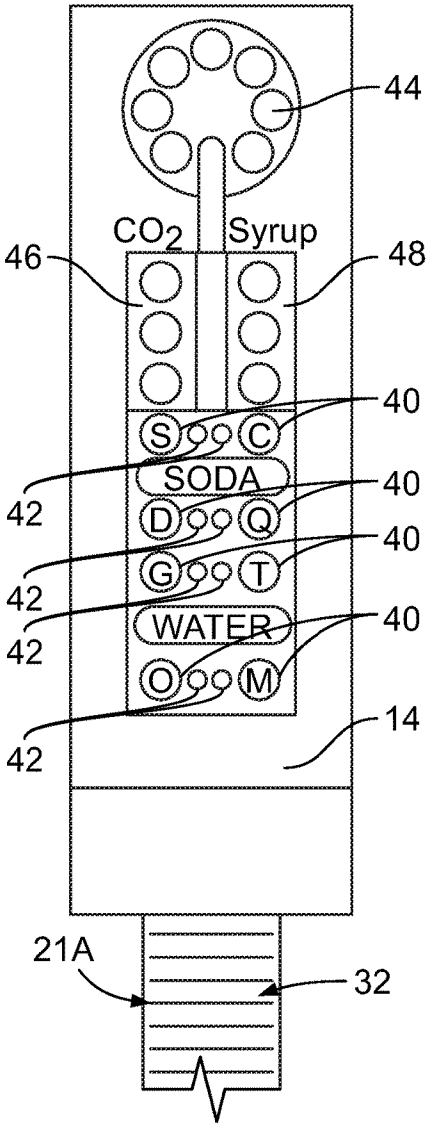
FIG. 2 is a dispenser gun in accordance with the disclosure.

Referring also to FIG. 2, the dispenser 14 is configured to receive water from the water source 24 through line 64 of the ingredient supply 12 and selected drink mix or syrup from the drink mix or syrup supply 28 via lines 22. The dispenser 14 also receives carbonated water through line 66. The dispenser 14 shown is a hand-held type device. The dispenser 14 may be sized and shaped to be held in the hand and operated by manually manipulating controls thereof. It will be understood that the dispenser 14 may be of a fixed type, which may be attached to a cabinet top, a bar, a housing, a self-contained, free-standing, integrated ingredient supply and dispenser unit and so on.

Selected ingredients entering the dispenser 14 from the ingredient supply 12 may be mixed in and dispensed from a nozzle 44 disposed in or attached to the dispenser. The dispenser 14 includes a plurality of individual controls 40, which when activated, select from plurality of possible combinations of water, carbonated water, and syrups, which are then received from the ingredient supply 12, mixed and dispensed from the nozzle 44. The controls 40 may be push buttons or any suitable control mechanism. The controls 40 are provided in communication with the controller 18 through signal wires 21A. Activating one of the controls 40 sends a signal to the controller 18, which generates a control signal to the corresponding component of ingredient supply 12 through signal wires 21B. For example, the control signal may enable the function of pump 56 to cause syrup to flow from container 28 throught line 22 to the dispenser 14. At the same time, carbonated water from carbonation vessel is enabled to flow through valve 34 and line 66 to the dispenser 14. The syrup and carbonated water travel through respective lines 22 and 66 through conduit 32 and are mixed in and dispensed from nozzle 44. The conduit 32 may be considered an umbilical that includes signal and fluid lines and power conduits.

The dispenser 14 also includes a first plurality of indicators 42 that display the status of the individual containers of drink base 28. A second set of indicators 46, 48 may respectively be provided for the $CO_2$ source 26 and each of the syrup sources 28. The second set of indicators 46, 48 may be in the form of a three-color set of indicators. In one embodiment, each of the set of indicators 46 may be colored green, which indicates sufficient $CO_2$ pressure, yellow, which indicates a low pressure level, and red, which indicates that the $CO_2$ supply is empty and must be changed. Similarly, the indicators 42 can be colored green, when sufficient syrup is contained in the repsective container, yellow, when the syrup is running low, and red when the syrup has been depleted. Likewise, the indicators 48 may also be in the form of the three-color set with similar indications. The indicators 42, 46, 48 may be LED type light emitting components or any suitable light emitting component.

The indicators 42, 46, 48 may be powered by power supply 16 and are actuated by controller 18 when the controller determines that a predetermined condition or threshold is met. For example, if one of the containers 28 is empty or nearly empty, which condition is sensed by weighing system 58 or in the alternative any suitable sensor, the controller 18 generates an alert and enables an appropriate one of the indicators 42 to be powered on. The illuminated alert thus generated alerts the operator that the container 28 must be changed immediately or soon, depending on the predetermined condition. In one embodiment, the condition is met when the container 28 is nearly empty. Other conditions are contemplated. For example, the green light for each button pressed may illuminate while the button is pressed and while sufficient supplies are sensed or otherwise determined to be available in the system. When a supply is running low or is determined to be below a warning threshold in the controller, the indicator may illuminate yellow and remain illuminated for a period after the button has been released, to catch the user's attention. When the particular supply is determined to be exhausted, the red illumination may stay on continuously after the button has been released to warn the user not to dispense that beverage until the supply has been replenished and the warning reset in the controller.

The type of alert component may be any suitable indicator. For example, the indicator may be a change of color, i.e., from green to red. Another example may be the generation of a warning sound. Yet another example may involve the presentation of information in written form or image(s). Any suitable alert indicator is contemplated.

In response to an operator switching the empty container 28 for a full container causes the controller 18 to reset and extinguish the alert. The controller 18 may include an automatic reset or a manual reset. The controller 18 may further include an option of entering and/or saving time and date information for every container that is replaced, and/or information about the expiration date of each container, which the user can enter, and a timer to alert the user when a container is about to reach its expiration or "use by" date, or a container that has been open for longer than the recommended period, so the user may replace that container to maintain freshness of the dispensed beverages.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A drink dispenser system, comprising:

an ingredient supply container including a beverage ingredient, the beverage ingredient being syrup for mixing with water, and the ingredient supply container being a bag that contains the syrup;

a source of water;

an ingredient supply sensor operatively associated with the ingredient supply container, the ingredient supply sensor being a weighing sensor configured to sense a first condition, a second condition, and a third condition, wherein in the first condition the ingredient supply container is empty, in the second condition the ingredient supply container is nearly empty, and in the third condition the ingredient supply container contains a sufficient amount of the syrup, wherein the ingredient supply sensor generates a weight signal indicative of the first, second or third condition;

a dispenser in fluid communication with the ingredient supply container and the source of water, the dispenser including a hand-held housing sized and shaped to be held in a user's hand, the hand-held housing including a nozzle in which an amount of beverage ingredient and water from the source are mixed and dispensed when a push button control included on the hand-held housing is pressed, the hand-held housing further including an indicator disposed on the housing adjacent the push button control; and a controller in communication with the ingredient supply sensor, the indicator, and the push button control through an umbilical, wherein the controller is configured to cause activation of the indicator in response to the weight signal from the sensor indicative of the first, second or third condition, and wherein activation of the indicator includes a first indication indicative of the first condition, a second indication indicative of the second condition, and a third indication indicative of the third condition when the push button control is pressed.

2. The drink dispenser system of claim 1, wherein the source of water is noncarbonated water.

3. The drink dispenser system of claim 1, wherein the source of water is carbonated water.

4. The drink dispenser system of claim 1, wherein the source of water is both noncarbonated and carbonated water.

5. The drink dispenser system of claim 1, wherein the hand-held housing is sized and shaped to be held and operated manually with one hand.

6. The drink dispenser system of claim 1, wherein the dispenser is a soda gun.

7. The drink dispenser system of claim 1, including a plurality of ingredient supply containers.

8. The drink dispenser system of claim 7, including a plurality of ingredient supply sensors, wherein each of the plurality of ingredient supply containers comprises one of the plurality ingredient supply sensors.

9. The drink dispenser system of claim 8, including a plurality of indicators, each of the plurality of indicators disposed adjacent to one of a plurality of push button controls on the hand-held housing of the dispenser, each of the plurality of indicators corresponding to one of the plurality of ingredient supply containers.

10. The drink dispenser system of claim 9, wherein the controller is configured to cause activation of the one of the plurality of indicators that corresponds to the corresponding one of the ingredient supply containers to indicate whether the corresponding one of the ingredient supply containers is in the first, second or third condition.

11. The drink dispenser system of claim 1, further comprising an additional ingredient supply sensor, the additional supply sensor being one of a weighing mechanism, a flow meter, a pressure sensor, and a level sensor.

12. The drink dispenser system of claim 1, wherein the indicator is a light emitting diode (LED), and wherein the LED is illuminated red in the first condition, yellow in the second condition, and green in the third condition.

13. The drink dispenser system of claim 1, wherein the push button control is configured to generate a dispensing signal when pressed by the user that causes the controller to enable the ingredient supply containers to convey a selected amount of beverage ingredient to the dispenser and the water supply to convey a selected amount of water to the dispenser through fluid lines extending through the umbilical and interconnecting the ingredient supply containers and the water supply with the nozzle in the dispenser.

14. The drink dispenser system of claim 13, wherein the dispenser includes a plurality of push button controls and a plurality of indicators, wherein the system includes a plurality of ingredient supply containers, wherein each push button control is operatively associated with one of the plurality of ingredient supply containers, and each of the plurality of indicators is disposed adjacent to a corresponding one of the push button controls to indicate the state of a corresponding one of the plurality of ingredient supply containers continuously and independently of whether each respective push button control is pressed.

15. A method for operating a soda gun, comprising:

providing an ingredient supply container including a beverage ingredient, the beverage ingredient being syrup for mixing with water, and the ingredient supply container being a bag that contains the syrup;

providing a source of water;

providing an ingredient supply sensor operatively associated with the ingredient supply container, the ingredient supply sensor being a weighing sensor configured to sense a an empty condition, a nearly empty condition, and a normal condition, wherein in the empty condition the ingredient supply container is empty, in the nearly empty condition the ingredient supply container is nearly empty, and in normal condition the ingredient supply container contains a sufficient amount of the syrup, wherein the ingredient supply sensor generates a weight signal indicative of empty, nearly empty, and the normal conditions;

providing a hand-held dispenser in fluid communication with the ingredient supply container and the source of water, the hand-held dispenser including a housing sized and shaped to be held in a user's hand, the housing including a nozzle in which an amount of beverage ingredient and water from the source are mixed and dispensed when a push button control included on the hand-held housing is pressed, the hand-held housing further including an indicator disposed on the housing adjacent the push button control; and a controller in communication with the ingredient supply sensor, the indicator, and the push button control through an umbilical;

wherein the controller causes activation of the indicator in response to the weight signal from the sensor indicative of the empty, nearly empty and normal condition, when the user presses the push button control by illuminating the indicator red for the empty condition, yellow for the nearly empty condition, and green for the normal condition; and wherein the user is alerted of the empty, nearly empty, or normal condition of the ingredient supply container by the indicator red, yellow or green illumination.

16. The method of claim 15, wherein the housing drink dispenser system of claim 1, wherein the housing is sized and shaped to be held and operated manually with one hand.

17. The method of claim 15, wherein the dispenser is a soda gun.

18. The method of claim 15, further comprising providing a plurality of ingredient supply containers, a plurality of ingredient supply sensors, a plurality of indicators, and a plurality of push button controls, wherein the user is alerted of the empty, nearly empty, or normal condition of each of the plurality of ingredient supply containers when the users presses each respective push button control associated with each respective ingredient supply container.

19. The method of claim 15, wherein the indicator is a light emitting diode (LED) configured to be illuminated in red, yellow or green.

20. The method of claim 15, wherein the indicator is illuminated red, yellow or green by the controller independently of whether the push button control is pressed.

* * * * *